United States Patent [19]

Mayer

[11] 4,340,939

[45] Jul. 20, 1982

[54] SOLID-STATE RESOLVER APPARATUS INCLUDING DIGITAL ANGLE MODIFIER

[76] Inventor: Arthur Mayer, 83-57 118th St., Kew Gardens, N.Y. 11415

[21] Appl. No.: 162,672

[22] Filed: Jun. 24, 1980

[51] Int. Cl.[3] ..... G06J 1/00; G06G 7/22

[52] U.S. Cl. ..... 364/603; 340/347 SY; 364/815

[58] Field of Search ..... 364/603, 607, 608, 729, 364/730, 815, 817, 818; 340/347 SY; 318/594, 661

[56] References Cited

U.S. PATENT DOCUMENTS

| | | | |
|---|---|---|---|
| 3,896,299 | 7/1975 | Rhodes | 364/603 |
| 3,952,187 | 4/1976 | Robinson et al. | 364/730 X |
| 3,974,367 | 8/1976 | Mayer | 364/603 |
| 3,976,869 | 8/1976 | Stella et al. | 364/603 |
| 3,984,672 | 10/1976 | Jones | 364/603 X |
| 4,097,858 | 6/1978 | Stella et al. | 340/347 SY |

OTHER PUBLICATIONS

"14 Bit Hybrid Control Differential Transmitter, HSCDX-14",-ILC Data Device Corporation, Bohemia, N.Y., TRG/RB-11/77.

"Digital Vector Generator"-Analog Devices, Norwood, Mass.-DTM 1716/1717 Series, Pub. C463-1-8-5/78.

*Primary Examiner*—Joseph F. Ruggiero

*Attorney, Agent, or Firm*—Spencer & Kaye

[57] ABSTRACT

A resolver apparatus for receiving simultaneously a vectorial input signal and an angular input signal. The apparatus comprises a first resolver, a second resolver and a digital angle modifier consisting of a memory and an adder. The angular input signal includes a first part which is coupled to the adder and a second part which is coupled to the adder and the memory. The memory generates at its output a correction signal which is a function of the second part of the angular input signal. The output of the adder includes first and second modified angular input signals which are coupled to the first and second resolver respectively to rotate the vectorial input signal through a total angle corresponding to the angular input signal.

7 Claims, 7 Drawing Figures

SOLID-STATE RESOLVER APPARATUS INCLUDING DIGITAL ANGLE MODIFIER

BACKGROUND OF THE INVENTION

The present invention relates to resolver apparatus for receiving an electrical input signal representing a vector quantity and generating an electrical output signal corresponding to the vector quantity rotated through a given angle. In particular, the invention comprises fine and coarse-angle solid-state resolver apparatus having excellent resolution and low error.

Broadly defined, a resolver is a computing device which resolves an input vector into two orthogonal components in the plane of the input vector. Resolvers may also be used to effect the rotation of an input vector through a desired angle to produce an output vector angularly displaced from and coplanar with the input vector.

Typically, the resolver is an electro-mechanical device comprising input and output windings rotatable with respect to each other by positioning a shaft attached to one set of windings. Analog voltages corresponding to the orthogonal components of the input vector are applied to the input windings and the shaft is mechanically rotated through the desired angle to produce voltages at the output windings corresponding to the orthogonal components of the rotated input vector.

In my U.S. Pat. No. 3,974,367, granted Aug. 10, 1976, there is disclosed a low-cost, reliable solid-state resolver apparatus wherein the orthogonal components of the input vector are represented by analog voltages and the total angle through which the input vector is to be rotated can be represented by an analog voltage or digitally by an ordered set of logic levels.

This prior art solid-state resolver apparatus comprises a coarse-angle resolver and a fine-angle resolver connected in cascade. The coarse-angle resolver receives a vectorial input signal having first and second components corresponding to the orthogonal components of the input vector and the fine-angle resolver receives the vectorial signal at the output of the coarse-angle resolver. The coarse-angle resolver further comprises two sub-resolvers connected in cascade.

The input signal applied to the resolver apparatus disclosed in my aforementioned patent also includes a third component or angular input signal corresponding to the total angle through which the input vector is to be rotated. This third component of the input signal has two parts—a first part which corresponds to the coarse part of the total angle and a second part which corresponds to the fine part of the total angle. The first part of the third component of the input signal is, in turn, subdivided into a first portion for controlling one of the sub-resolvers and a second portion for controlling the other of the sub-resolvers. The voltage at the input of the second cascaded sub-resolver corresponds to the voltage applied to the first sub-resolver rotated through the first part of the total angle.

The second part of the third component of the input signal controls the fine-angle resolver to produce voltages at the output thereof which correspond closely to the orthogonal components produced by rotation of the signal applied to the input of the fine-angle resolver through the second part of the total angle. Thus, the voltages at the output of the resolver apparatus comprising the cascaded coarse-angle sub-resolvers and fine-angle resolver correspond closely to the orthogonal components produced by rotation of the signal applied to the input of the resolver apparatus through the total angle.

In my aforementioned patented resolver apparatus, the magnitude of the vector obtained by vectorially adding the orthogonal components at the output of the fine-angle resolver is the same as the magnitude of the input vector applied to the coarse-angle resolver. However, the angle of the output vector with respect to the input vector is not exactly equal to the total angle. Rather, it is slightly in error because the fine-angle resolver implements small-angle equations rather than the ideal resolver equations in order to reduce the complexity of the electronic hardware comprising the fine-angle resolver. This error can be as much as 0.014° when the second part of the third component of the input signal is ±6.5°.

SUMMARY OF THE INVENTION

While the accuracy of the solid-state resolver apparatus disclosed in my aforementioned patent is quite good and is satisfactory for many purposes, it is desirable to further increase its accuracy without unduly adding to the complexity and cost of the apparatus. I have been able to accomplish this objective by adding a digital angle modifier to the system while at the same time eliminating one of the sub-resolvers comprising the coarse-angle resolver. This permits the omission of six amplifiers, two multiplexers and eighteen resistors from one embodiment of my patented solid-state resolver.

More specifically, the present invention employs the digital angle modifier to modify the angular input signal to the fine-angle resolver so that the fine-angle resolver accurately rotates the vector applied to the resolver apparatus through the fine part of the total angle. The digital angle modifier includes a memory having a correction factor stored therein and an adder which adds the correction factor to the angular input signal. The coarse and fine-angle resolvers are controlled by the output of the adder.

DESCRIPTION OF THE PREFERRED EMBODIMENTS

Figure 1:
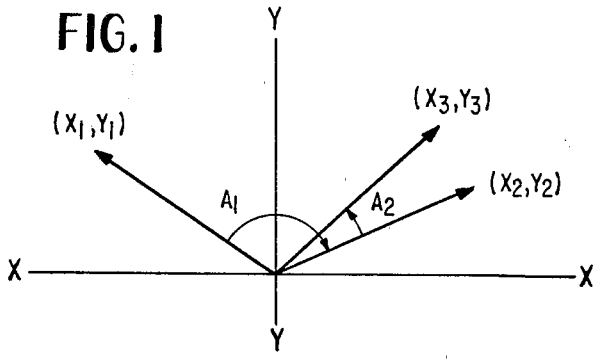
FIG. 1 is a vector diagram useful in explaining operation of the resolver apparatus.

Referring to the vector diagram of FIG. 1, an input vector is shown rotated from a first position having the coordinates, $X_1$, $Y_1$ through an angle $A_1$ to a second position having the coordinates $X_2$, $Y_2$. This rotation may be defined by the equations:

$$X_2 = X_1 \cos A_1 - Y_1 \sin A_1$$

$$Y_2 = X_1 \sin A_1 + Y_1 \cos A_1 \qquad (1)$$

If the input vector is then rotated through an angle $A_2$ from its second position to a third position having the coordinates $X_3$, $Y_3$:

$$X_3 = X_2 \cos A_2 - Y_2 \sin A_2$$

$$Y_3 = X_2 \sin A_2 + Y_2 \cos A_2 \quad (2)$$

and, combining equations (1) and (2)

$$X_3 = X_1 \cos (A_1 + A_2) - Y_1 \sin (A_1 + A_2)$$

$$Y_3 = X_1 \sin (A_1 + A_2) + Y_2 \cos (A_1 + A_2) \quad (3)$$

The convention adopted in applying equations (1), (2) and (3) to FIG. 1 is that counterclockwise rotation is positive. Thus, in FIG. 1, $A_1$ is negative and $A_2$ is positive.

Figure 2:
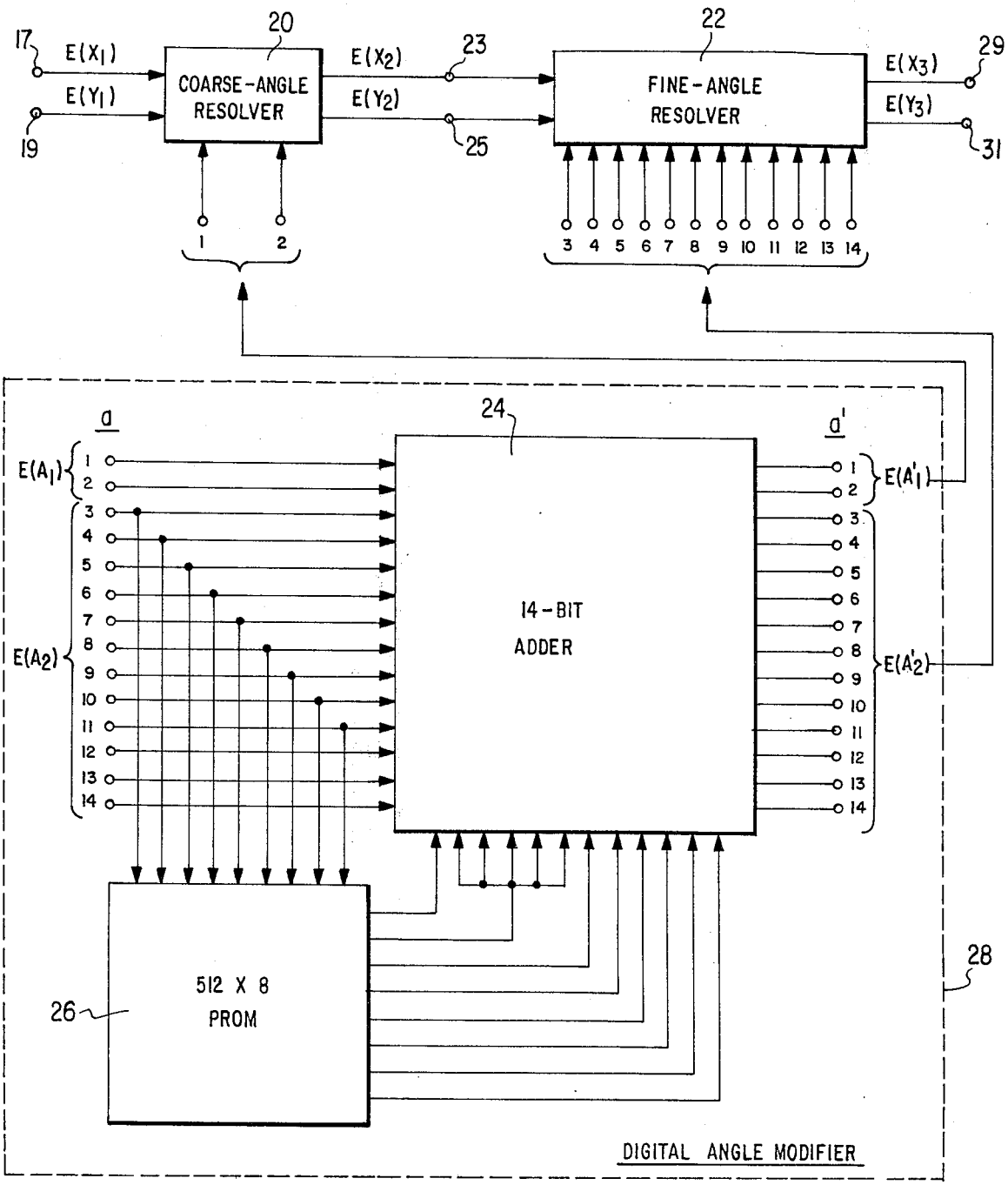
FIG. 2 is a block diagram of the invention.

Equations (3) imply that two resolvers with input angles $A_1$ and $A_2$ may be coupled in cascade to perform as a single resolver with the input angle $A = A_1 + A_2$. As shown in FIG. 2, analog voltages $E(X_1)$ and $E(Y_1)$ corresponding to the orthogonal coordinates $X_1$, $Y_1$ are applied to input terminals 17 and 19 of a coarse-angle resolver 20. A digital signal $E(A'_1)$ is also applied to resolver 20. This results in voltages $E(X_2)$ and $E(Y_2)$ being generated at the output terminals 23 and 25 of resolver 20 corresponding to the orthogonal coordinates $X_2$, $Y_2$.

Voltages $E(X_2)$ and $E(Y_2)$ are applied to the input of a fine-angle resolver 22. Also applied to resolver 22 is a digital signal $E(A'_2)$, the signals combining to provide at the output terminals 29 and 31 of resolver 22 voltages $E(X_3)$ and $E(Y_3)$ corresponding to the coordinates $X_3$, $Y_3$ obtained by rotating the vector $X_1$, $Y_1$ through the angle $A = A_1 + A_2$. It will be understood that, as used in this specification, the symbols X, Y and A may refer to either a mathematical quantity or a voltage corresponding to that mathematical quantity.

In the specific embodiment to be discussed, the angle A is represented by a 14-bit binary number applied to terminals $a_{1\text{-}14}$ of a 14-bit adder 24. Terminals $a_{3\text{-}11}$ of the adder are connected to a $512 \times 8$ programmable read-only memory (PROM) 26 which has its output connected to the 14-bit adder 24, adder 24 and PROM 26 comprising a digital angle modifier 28. Output terminals $a'_{1\text{-}2}$ of the adder are connected to input terminals 1 and 2, respectively, of the coarse-angle resolver 20 and output terminals $a'_{3\text{-}14}$ are connected to input terminals 3–14, respectively, of the fine-angle resolver 22. In general, the bit applied to each of the terminals $a_{1\text{-}14}$ represents an angle of $360° \times 2^{-n}$, where n is a number corresponding to the number of the terminals. Thus, the most significant bit of the 14-bit binary number representing angle A is applied to terminal $a_1$ of the adder 24 and represents an angle of 180°, the next most significant bit is applied to terminal $a_2$ and represents an angle of 90°, the bit applied to terminal $a_3$ represent an angle of $360° \times 2^{-3} = 45°$ and the least significant bit applied to terminal $a_{14}$ represents an angle of $360° \times 2^{-14} = 0.022°$ or 79″ of arc.

The bits applied to terminals $a_1$ and $a_2$ of the 14-bit adder 24 comprise the input signal $E(A_1)$ corresponding to the angle $A_1$. The bits applied to terminals $a_3$ to $a_{14}$ of the adder 24 comprise the input signal $E(A_2)$ corresponding to the angle $A_2$. The bits at the output terminals $a'_1$ and $a'_2$ of the adder 24 comprise the signal $E(A'_1)$ and the bits at the output terminals $a'_3$ to $a'_{14}$ of adder 24 comprise the signal $E(A'_2)$.

The coarse angle resolver 20 is used to rotate the vector $V_1 = X_1 + jY_1$ applied to terminals 17 and 19 through an angle $A'_1$ of 0°, 90°, 180° or 270° in response to the binary output $E(A'_1)$ to generate the voltage $V_2 = X_2 + jY_2$ at terminals 23, 25. The fine-angle resolver 22 rotates the vector $V_2$ applied to terminals 23, 25 through angles $A'_2$ between −45° and +45° in steps of 0.022° in response to the binary input $E(A'_2)$ to generate the voltage $V_3 = X_3 + jY_3$ at terminals 29,31.

While the coarse-angle resolver 20 can be constructed with relatively simple circuitry to produce rotation of an input voltage through 90° increments, the fine-angle resolver implementation is more complicated.

Referring to the exact resolver equations (2), they may be rewritten in the form:

$$V_3 = V_2 \epsilon^{jA_2} \quad (4)$$

where $V_2$ and $V_3$ have the definitions given above and $$\epsilon^{jA_2} = \cos A_2 + j \sin A_2$$

Multiplying both sides of equation (4) by $\epsilon^{-j(A_2/2)}$ gives $$V_3 \epsilon^{-j\frac{A}{2}2} = V_2 \epsilon^{j\frac{A}{2}2}$$

which can be expanded as $$(X_3 + jY_3)\left(\cos\frac{A_2}{2} - j\sin\frac{A_2}{2}\right) = (X_2 + jY_2)\left(\cos\frac{A_2}{2} + j\sin\frac{A_2}{2}\right)$$

Separating the real and imaginary parts of this equation and dividing both sides of the two resulting equations by $\cos (A_2/2)$ yields $$X_3 = X_2 - (Y_3 + Y_2)\tan\frac{A_2}{2} \quad (5)$$

$$Y_3 = Y_2 + (Y_3 + Y_2)\tan\frac{A_2}{2}$$

Equations (5) are easier to implement than equations (2) provided $\tan (A_2/2)$ is available as a digital input. In my aforementioned U.S. Pat. No. 3,974,376, disclosing a solid-state resolver, the term $\tan (A_2/2)$ is replaced by a linear factor which is proportional to the angle $A_2$. This produces a resolver which is accurate to within 1° and is adequate for many purposes. However, there are applications in which greater accuracy is required and this may be achieved by my present invention without significant modification of the fine-angle resolver disclosed in U.S. Pat. No. 3,974,367.

Figure 3:
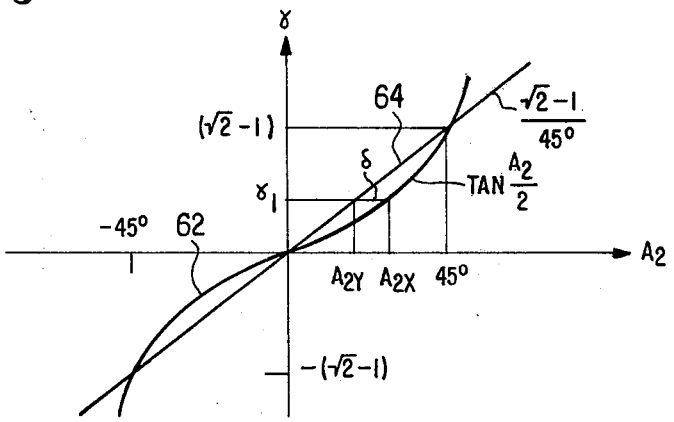
FIG. 3 is a graph useful in explaining the operation of the invention of FIG. 2.

Referring to FIG. 3, curve 62 is a plot of the function:

$$\gamma = \tan\frac{A_2}{2} \quad (6)$$

between the angles of $-45°$ and $+45°$.

When $A_2=\pm 45°$, $\gamma=\pm(\sqrt{2}-1)$ since $\tan(45°/2)=\sqrt{2}-1$. A straight line 64 drawn through the point $\pm 45°$, $\pm(\sqrt{2}-1)$ is defined by the equation $$\gamma = \frac{\sqrt{2}-1}{45°} A_2 \tag{7}$$

Equation (7), which corresponds to the linear approximation used in my previously patented resolver apparatus, differs from the exact value expressed by equation (6) and therefore is in error for values of $A_2$ other than $0°$ and $\pm 45°$.

For an arbitrary value of $A_2$ designated $A_{2x}$, the ordinate $\gamma$ on the true curve 62 has the value $\tan(A_{2x}/2)$. This value of $\gamma$ is also attained on the straight line 64 at another value of the angle $A_2$ designated $A_{2y}$ such that:

$$\frac{\sqrt{2}-1}{45°} A_{2y} = \tan\frac{A_{2x}}{2} \text{ or}$$

$$A_{2y} = \frac{45°}{\sqrt{2}-1} \tan\frac{A_{2x}}{2}$$

The horizontal distance $\delta$ from the true curve 62 to the straight line 64 is $$\delta = A_{2y} - A_{2x} = \frac{45°}{\sqrt{2}-1} \tan A_{2x} - A_{2x} \tag{8}$$

The curvature of the graph 62 of $\tan(A_2/2)$ is greatly exaggerated in FIG. 3. Actually, the magnitude of $\delta$ is always less than 1° as long as $-45° \leqq A_{2x} \leqq 45°$, and it is apparent that $\delta$ vanishes for $A_{2x}=0°$ and $\pm 45°$.

Figure 4:
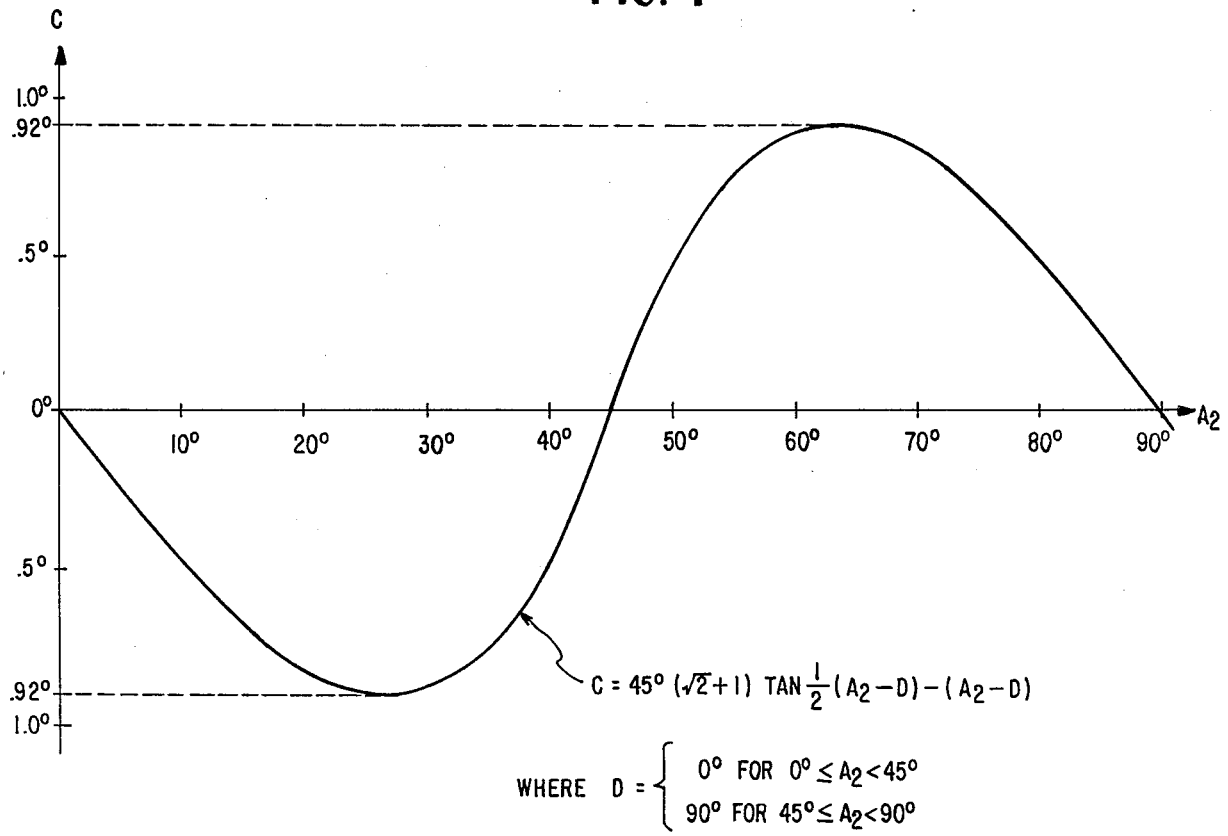
FIG. 4 is a graph showing the correction factor stored in the memory of the digital angle modifier used in the invention.

Equation (8) and FIG. 4 show that if a correction factor corresponding to $\delta$ were added to the angle $A_2$ to produce the angular input to the fine-angle resolver 22, the error which occurs when the linear approximation to curve 64 is used would be eliminated. This is the purpose of the digital angle modifier 28 comprising the 14-bit adder 24 and 512×8 PROM 26. That is, the digital-angle modifier 28 takes a 14-bit input A and produces a new 14-bit number A' to control the coarse and fine-angle resolvers 20 and 22 in such a way that the coarse-angle resolver accurately rotates the input vector to the resolver apparatus through the angle $A_1$ (equal to 0°, 90°, 180° or 270°) and the fine-angle resolver accurately rotates the voltage applied to its input through an angle $A_2$ such that $A_1+A_2=A$.

The PROM 26 is addressed by the first nine bits of the signal $E(A_2)$ applied to terminals $a_{3\text{-}11}$ of the adder 24. It is programmed to apply the sum of a correction factor C and a constant factor equal to 45° to the adder 24. The correction factor C corresponds to equation (8) and is expressed as $$C = 45°(\sqrt{2}+1)\tan\tfrac{1}{2}(A_2 - D) - (A_2 - D), \tag{9}$$

where $$\sqrt{2}+1 = \frac{1}{\sqrt{2}-1}$$

and D is a mathematical step function which allows for the effect of the carry operations which take place in the adder 24. This step function is expressed as $$D = \begin{cases} 0° \text{ for } 0° \leqq A_2 < 45° \\ 90° \text{ for } 45° \leqq A_2 < 90° \end{cases}$$

and, with reference to FIG. 3, it is seen that as $E(A_2)$ at the input of adder 24 ranges from 0° to 90°, the angle $A_2-D$ stays within the range of $\pm 45°$. A plot of the value of the correction factor C as a function of $A_2$ is shown in FIG. 4.

The 45° term added by PROM 26 to the correction factor C is necessary because the multiplying digital-to-analog converters employed in the fine-angle resolver 24, to be described in detail hereinafter, would introduce an error of 45° in the total angle A. The 45° term programmed into the PROM compensates for the effect of these converters.

The rate of change of the angle C with respect to the angle $A_2$ is never greater than 0.125. Therefore, the last three bits of the angle A are too insignificant to affect the value of C. Consequently, only the nine bits applied to terminals $a_{3\text{-}11}$ of the adder 24 are applied to the PROM 26.

Each memory location in the PROM need contain only eight bits, even though the adder requires a 14-bit input. This is because C is a small angle, confined to the range $\pm 0.92°$ as shown in FIG. 4. The corresponding range of $(45°+C)$ is from 44.08° to 45.92°, and these two extremes are represented digitally at the input to the adder by 00011111010110 and 00100000101010 respectively. It is apparent that the in-between-values of $(45°+C)$ all have two leading zeros, so there is no need to provide memory space for the first two bits. The third bit is a zero for $C<0°$, and a one for $C \geqq 0°$; that bit is stored in the PROM. The next five bits are all ones for $C<0°$, and they are all zeros for $C \geqq 0°$; those five bits are stored as one and fanned out to five, as indicated in FIG. 2. The last six bits are whatever the value of C requires them to be, and they are all stored in the PROM. In other words, the first two bits of the 14-bit representation of $(45°+C)$ are not stored in memory; the next six bits are stored as two; and the last six bits are stored as they are.

The PROM may be programmed by calculating the 8-bit output for each of the 512 input addresses from 0–511 using equation (9) or FIG. 4. For example, an input 010011110 at terminals $a_{3\text{-}11}$ of the adder 24 represents an input address 158 to the PROM. This address corresponds to an input $A_2$ of 010011110000 on terminals $a_{3\text{-}14}$ or 27.77°. From equation (9) or FIG. 4, the correction angle for $A_2=27.77°$ is equal to $-0.92°$. Adding 45° to $-0.92°$ gives an input to the adder of 44.08° which corresponds to a binary input to the adder of 011111010110. Since the second to sixth bits are the same, the output of the PROM is 01010110. Thus, the output for the input 158 is written as 086. Table I shows typical inputs and outputs for the 512×8 PROM 26 which can be used for writing a complete program for the PROM.

TABLE I

| PROM INPUT | PROM OUTPUT |
|---|---|
| 0 | 128 |
| 52 | 107 |

TABLE I-continued

| PROM INPUT | PROM OUTPUT |
|---|---|
| 104 | 092 |
| 156 | 086 |
| 208 | 097 |
| 260 | 131 |
| 312 | 162 |
| 364 | 170 |
| 416 | 163 |
| 468 | 146 |
| 511 | 128 |

The digital angle modifier can be fabricated from commercially available components such as a 4k PROM(512×8), type SN 74S472 manufactured by Texas Instruments, Inc. and four Texas Instrument 4-bit full adders, Type SN 74LS283.

The output of the adder 24 appearing at terminals $a'_1$ and $a'_2$ corresponds to $A'_1=A_1+D$, where D represents the effect of the carry into the output at terminal $a'_2$ when the most significant digit of $A_2$ is a 1. The output of the adder 24 appearing at terminals $a'_{3\text{-}14}$ corresponds to $A'_2=A_2+C+45°$.

Table II completely expresses the output of the coarse-angle resolver 20 in response to the binary signals at terminals $a'_1$ and $a'_2$ of the adder.

TABLE II

| | E(A'1) | | | |
|---|---|---|---|---|
| A'1 | a'1 | a'2 | X2 | Y2 |
| 0° | 0 | 0 | X1 | Y1 |
| 90° | 0 | 1 | −Y1 | X1 |
| 180 | 1 | 0 | −X1 | −Y1 |
| 270 | 1 | 1 | Y1 | −X1 |

Figure 5:
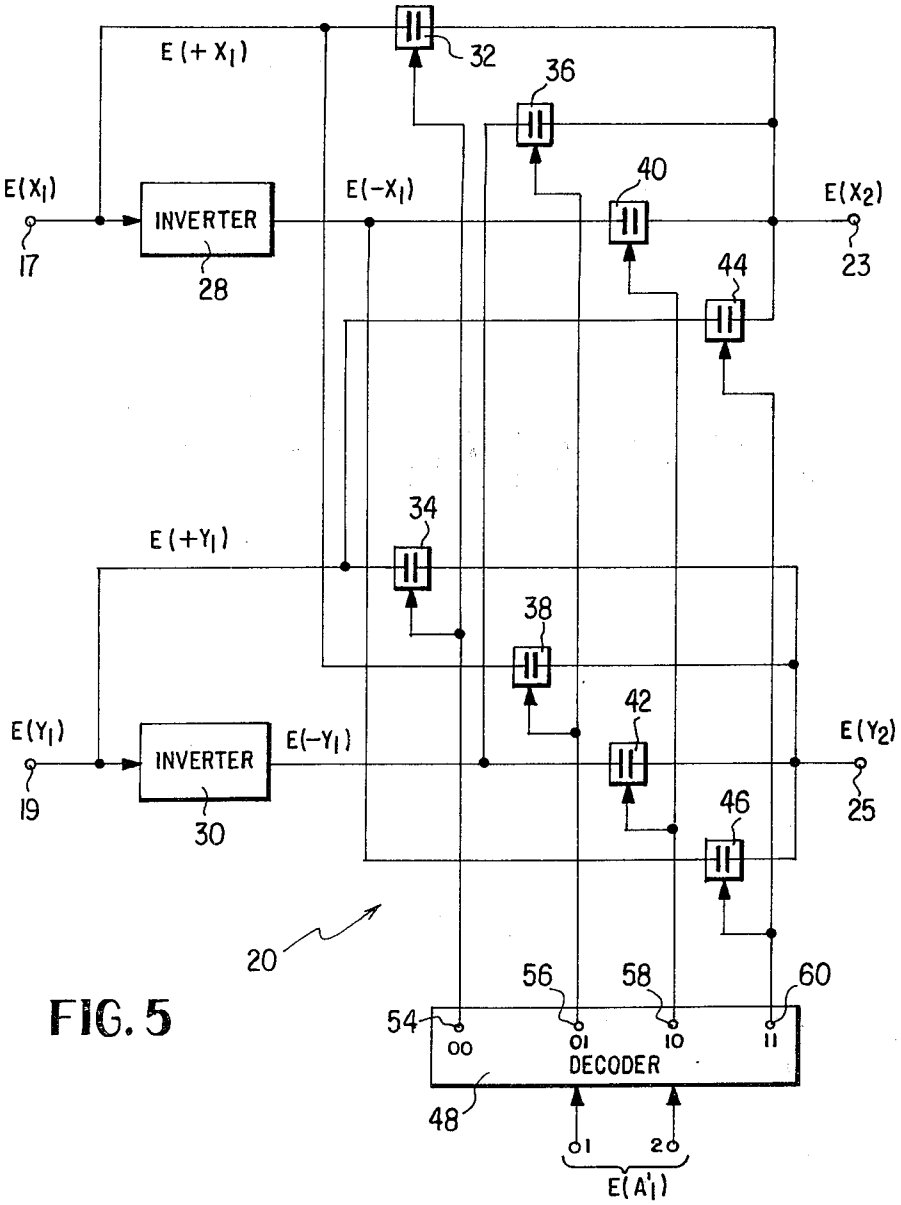
FIG. 5 is a schematic diagram of the coarse-angle resolver.

A typical circuit for coarse-angle resolver 20 is shown in FIG. 5. In resolver 20 the input voltages $E(X_1)$ and $E(Y_1)$ representing the vectorial signal $V_1$ are applied to inverters 28 and 30 respectively and also to switches 32, 38 and 34, 44 respectively. Switches 32, 34, 38 and 44 are part of a network of eight switches which also includes switches 36, 40, 42 and 46 all of which are controlled by a decoder 48.

Decoder 48 receives the 2-bit signal $E(A'_1)$ consisting of the first two bits of $A'_1$ at input terminals 1 and 2 respectively. If the signals on terminals 1 and 2 of decoder 48 are both zero (00), then the decoder output terminal 54 is energized closing switches 32 and 34. Similarly, if the input signal at terminals 1 and 2 is 01, 10 or 11, a corresponding terminal 56, 58 or 60 is energized. A 01 signal energizes terminal 56 closing switches 36 and 38, a 10 signal energizes terminal 58 closing switches 40 and 42 and a 11 signal energizes terminal 60 closing switches 44 and 46.

The output of inverter 28 is connected to the inputs of switches 40 and 46 and the output of inverter 30 is connected to the inputs of switches 36 and 42. The outputs of switches 32, 36, 40 and 44 are connected together to deliver a voltage $E(X_2)$ at output terminal 23 corresponding to the coordinate $X_2$ of a vector $V_2$ obtained by rotating the input vector $X_1$, $Y_1$ through the angle $A'_1$. Similarly, the outputs of switches 34, 38, 42 and 46 are connected together to deliver a voltage $E(Y_2)$ at output terminal 25 corresponding to the coordinate $Y_2$ of the vector obtained by rotating the input vector through the angle $A'_1$.

When the decoder input signal $E(A'_1)$ is 00, switches 32 and 34 are closed and the output voltages $E(X_2)$ and $E(Y_2)$ are equal to $E(X_1)$ and $E(Y_1)$ in accordance with Table II. Similarly, a decoder input signal 01 closes switches 36 and 38 making the voltage $E(X_2)$ equal the voltage $E(-Y_1)$ at the output of inverter 30 and the output voltage $E(Y_2)$ equal the input voltage $E(X_1)$. In the same way, it can be seen that the voltages $E(X_2)$ and $E(Y_2)$ at the outputs of coarse-resolver 20 correspond to $E(-X_1)$, $E(-Y_1)$ and $E(Y_1)$, $E(-X_1)$ respectively when $A'_1$ equals 10 and 11. While coarse-angle resolver 20 comprises part of my invention, it is not novel per se and the same results could be achieved using other types of circuitry.

The fine-angle resolver 22 receives voltage $E(X_2)$ and $E(Y_2)$ from the output of coarse-angle resolver 20.

Figure 6:
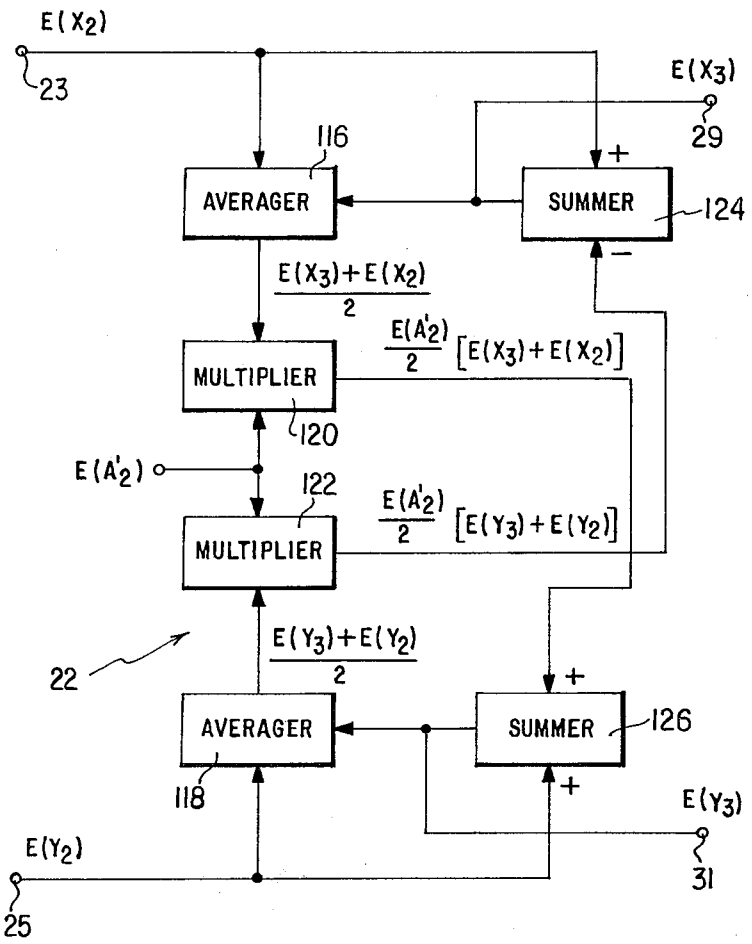
FIG. 6 is a block diagram of the fine-angle resolver.

Referring to FIG. 6, the fine-angle resolver 22 comprises first and second averaging circuits 116 and 118 which form the averages of the input and output voltages $$\frac{E(X_3)+E(X_2)}{2} \text{ and } \frac{E(Y_3)+E(Y_2)}{2}$$

respectively. Two multipliers 120 and 122 form the product of these averages with the input $E(A'_2)$ producing the outputs $$\frac{E(A'_2)}{2}[E(X_3)+E(X_2)] \text{ and } \frac{E(A'_2)}{2}[E(Y_3)+E(Y_2)]$$

respectively. It shall be understood that the fine-angle resolver 22 of FIG. 6 has 12 terminals for receiving the 12-bit signal $E(A'_2)$. However, in order to avoid crowding the drawing, these terminals have been omitted from FIG. 6.

Summing circuit 124 receives as inputs the input voltage $E(X_2)$ and the output of multiplier 122 to produce the output voltages $E(X_3)$ as the algebraic difference between these inputs. Similarly, summing circuit 126 receives as inputs the input voltage $E(Y_2)$ and the output of multiplier 120 to produce the output voltage $E(Y_3)$ as the algebraic sum of these inputs.

More specifically, the angular input $E(A'_2)$ is applied to the inputs of multipliers 120 and 122. The input voltage $E(X_2)$ is coupled to an input of averager 116 and also to an input of summer 124. The voltage $E(Y_2)$ is coupled to an input of averager 118 and also to an input of summer 126. The output of averager 116 is connected to an input of multiplier 120 and the output of averager 118 to an input of multiplier 122. The outputs of multipliers 120 and 122 are coupled respectively to inputs of summer 126 and 124.

Since the input to averager 116 from summer 124 is $E(X_3)$ and the other input is $E(X_2)$ the signal fed to multiplier 120 is $$\frac{E(X_2)+E(X_3)}{2}.$$

Multiplier 120 multiplies the input $E(A'_2)$ by the output of averager 116 to obtain the output $$\frac{E(A'_2)}{2}[E(X_3)+E(X_2)]$$

This output, when coupled to a positive input of summer 126 is added to the input $E(Y_2)$ to obtain $$\frac{E(A'_2)}{2}[E(X_3) + E(X_2)] + E(Y_2).$$

Since $$\frac{A'_2}{2}(X_3 + X_2) + Y_2 = Y_3$$

it follows that the voltage at output terminal 31 is $E(Y_3)$.

Similarly, the output of multiplier 122 is $$\frac{E(A'_2)}{2}[E(Y_3) + E(Y_2)]$$

and when this is subtracted from the input $E(X_2)$ in summer 124 the output of the summer at terminal 29 is $$E(X_2) - \frac{E(A'_2)}{2}[E(Y_3) + E(Y_2)] = E(X_3)$$

Figure 7:
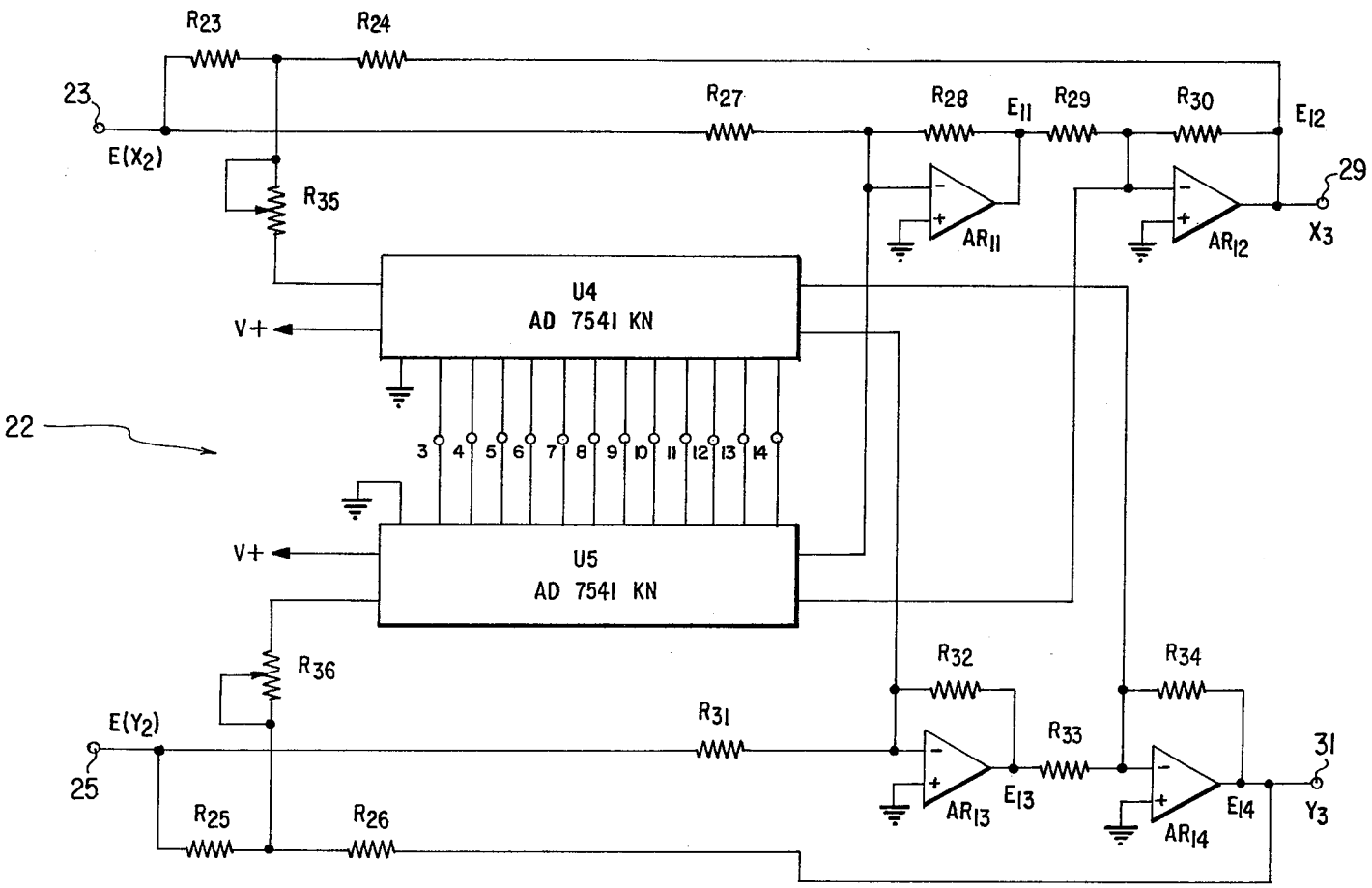
FIG. 7 is a practical embodiment of the fine-angle resolver of FIG. 6.

The fine-angle resolver shown in block diagram form in FIG. 6 is illustrated in greater detail in FIG. 7. In FIG. 7 two matched pairs of resistors $R_{23}$, $R_{24}$ and $R_{25}$, $R_{26}$ serve as the averaging circuits 116 and 118 of FIG. 6. The multipliers 120 and 122 are realized by two integrated circuits $U_4$ and $U_5$ which may be type AD7541KN manufactured by Analog Devices; the AD7541KN being a monolithic 12-bit multiplying digital-to-analog converter.

Both multipliers $U_4$ and $U_5$ have the common input $E(A'_2)$. $E(A'_2)$ is represented in FIG. 7 by 12 binary bits coupled to terminals 3–14 of each of the integrated circuits $U_4$ and $U_5$, the most significant bit being applied to terminals 3 and the least significant bit to terminal 14.

Two matched pairs of resistors $R_{27}$, $R_{30}$ and $R_{28}$, $R_{29}$, together with operational amplifiers $AR_{11}$ and $AR_{12}$ comprise summer 124 of FIG. 6 and two matched pairs of resistors $R_{31}$, $R_{34}$ and $R_{32}$, $R_{33}$, together with operational amplifiers $AR_{13}$, $AR_{14}$ make up summer 126. In a typical embodiment, all 12 resistors $R_{23}$–$R_{34}$ have a nominal value of 20,000 ohms.

Two adjustable resistors $R_{35}$, $R_{36}$ compensate for the broad manufacturing tolerance on input impedance which is inherent in these converters. The fine-angle resolver is disclosed in greater detail in my U.S. Pat. No. 3,974,367.

With a 14-bit digital input the angular resolution of the described resolver apparatus is 79″ or 0.022°. The angular accuracy with resistor pairs matched to 0.025% is 60″ and the functional accuracy is 0.025%. Digital switching speed is 1 μs, settling time is 5 μs with a 0.01% 10-V step at the output, and the bandwidth is dc to 50 kHz. If an angular accuracy of 1 milliradian ($3\frac{1}{3}'$) is sufficient, 0.1% resistors may be used. On the other hand, if 20″ accuracy is required, all the resistor pairs should be matched to 0.01% and high precision operational amplifiers employed.

Also, although in the described embodiment the fine-angle resolver 22 follows the coarse-angle resolver, this order may be reversed without significantly affecting operation of the resolver apparatus.

It will be understood that the above description of the present invention is susceptible to various modifications and changes, and the same are intended to be comprehended within the meaning and range of equivalents of the appended claims.

What is claimed is:

1. Resolver apparatus for receiving simultaneously a vectorial input signal and an angular input signal, said vectorial input signal having first and second components corresponding respectively to the orthogonal components of an input vector and said angular input signal having first and second parts corresponding to first and second angles, respectively, said apparatus generating a vectorial output signal having first and second components corresponding respectively to the orthogonal components of an output vector produced by rotation of said input vector through the sum of said first and second angles, comprising:

first resolver means for receiving said vectorial input signal and generating a vectorial intermediate signal having first and second components;

second resolver means for receiving said vectorial intermediate signal and generating said vectorial output signal, one of said first and second resolver means being a coarse-angle resolver and the other a fine-angle resolver;

memory means for receiving one of said first and second parts of said angular input signal and generating at its output a correction signal, said correction signal being a function of said one part of said angular input signal; and adding means for adding said angular input signal and the output of said memory means, the output of said adding means being coupled to the inputs of said first and second resolver means to apply first and second modified angular input signals respectively thereto, said first modified angular input signal causing said first resolver means to rotate said vectorial input signal through an angle corresponding to the first part of said angular input signal and said second modified angular input signal causing said second resolver means to rotate said vectorial intermediate signal through an angle corresponding to the second part of said angular input signal.

2. Resolver apparatus as defined by claim 1, wherein said first and second resolver means are coarse and fine-angle resolvers respectively, the first part of said angular input angle corresponds to a coarse-angle $A_1$ and the second part of said angular input signal corresponds to a fine-angle $A_2$, said vectorial input signal being rotated through an angle $A_1+A_2$ by said coarse and fine-angle resolvers to generate said vectorial output signal.

3. Resolver apparatus as defined by claim 2, wherein said coarse-angle resolver comprises:

inverter means for receiving the two components of said vectorial signal; and switching means coupled to said inverter means and having first and second outputs, said switching means receiving said first modified angular input signal from said adding means and generating signals at its first and second outputs corresponding to the orthogonal components of said vectorial intermediate signal produced by rotation of said vectorial input signal through said angle $A_1$.

4. Resolver operation as defined by claim 2 wherein said fine-angle resolver comprises:

first and second averaging means, each having a first input, a second input and an output, said first inputs of said first and second averaging means respectively receiving the first and second components of said vectorial intermediate signal;

first and second multiplying means, each having a first input, a second input and an output, said first inputs of said first and second multiplying means being coupled respectively to the outputs of said first and second averaging means, and said second inputs of said first and second multiplying means both receiving said second modified angular input signal from said adding means; and first and second summing means, each having a first input, a second input and an output, said first inputs of said first and second summing means respectively receiving the same signal components received by said first inputs of said first and second averaging means, said second inputs of said first and second summing means being coupled to the outputs of said second and first multiplying means respectively, and said outputs of said first and second summing means being coupled to said second inputs of said first and second averaging means respectively, said first and second summing means generating at their respective outputs the first and second components of said vectorial output signal.

5. Resolver apparatus as defined by claim 2 wherein the input to said memory means is the second part of said angular input signal.

6. Resolver apparatus as defined by claim 3 wherein the output of said memory means is given by the equation:

$$C = 45^\circ (\sqrt{2} + 1) \tan\tfrac{1}{2} (A_2 - D) - (A_2 - D) + 45^\circ,$$

where $$D = \begin{cases} 0^\circ \text{ for } 0^\circ \leqq A_2 < 45^\circ \\ 90^\circ \text{ for } 45^\circ \leqq A_2 < 90^\circ. \end{cases}$$

7. Resolver apparatus for receiving simultaneously a vectorial input signal and an angular input signal, said vectorial input signal having first and second components corresponding respectively to the orthogonal components of an input vector and said angular input signal corresponding to an angle of rotation, said apparatus generating a vectorial output signal having first and second components corresponding respectively to the orthogonal components of an output vector produced by rotation of said input vector through said angle of rotation, comprising:

memory means for receiving said angular input signal and generating at its output a correction signal, said correction signal being a function of said angular input signal;

adding means for adding said angular input signal and said correction signal to produce a modified angular signal; and resolver means for receiving said vectorial input signal and said modified angular signal, said modified angular signal causing said resolver means to rotate said vectorial input signal through said angle of rotation.

* * * * *